US009362616B2

(12) United States Patent
Bogdans

(10) Patent No.: US 9,362,616 B2
(45) Date of Patent: Jun. 7, 2016

(54) STRENGTHENING MEANS FOR A DIPOLE WHIP ANTENNA

(75) Inventor: Paul A. Bogdans, Grand Haven, MI (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 275 days.

(21) Appl. No.: 14/111,665

(22) PCT Filed: May 2, 2011

(86) PCT No.: PCT/US2011/034767

§ 371 (c)(1),
(2), (4) Date: Oct. 14, 2013

(87) PCT Pub. No.: WO2012/150924

PCT Pub. Date: Nov. 8, 2012

(65) Prior Publication Data

US 2014/0028517 A1 Jan. 30, 2014

(51) Int. Cl.

| | |
|---|---|
| ***H01Q 21/00*** | (2006.01) |
| ***H01Q 1/46*** | (2006.01) |
| ***H01Q 9/22*** | (2006.01) |
| ***H01Q 9/16*** | (2006.01) |
| ***H01Q 1/42*** | (2006.01) |
| ***H01Q 21/10*** | (2006.01) |
| ***H01Q 1/08*** | (2006.01) |

(52) U.S. Cl.

CPC ..... *H01Q 1/46* (2013.01); *H01Q 1/085* (2013.01); *H01Q 1/42* (2013.01); *H01Q 9/16* (2013.01); *H01Q 9/22* (2013.01); *H01Q 21/10* (2013.01)

(58) Field of Classification Search

CPC ..... H01Q 1/46; H01Q 9/46
USPC ..... 343/810, 793
See application file for complete search history.

(56) References Cited

U.S. PATENT DOCUMENTS

| | | | | |
|---|---|---|---|---|
| 4,963,879 | A | 10/1990 | Lin | |
| 5,446,473 | A | 8/1995 | Nielsen | |
| 7,164,389 | B1 | 1/2007 | Platt | |
| 2003/0206140 | A1 | 11/2003 | Thornberg et al. | |
| 2005/0253768 | A1* | 11/2005 | Bui Hung | H01Q 5/00 343/790 |
| 2007/0040758 | A1 | 2/2007 | Dwyer et al. | |
| 2007/0132650 | A1 | 6/2007 | Lalezari | |
| 2009/0051609 | A1 | 2/2009 | Packer et al. | |
| 2014/0247193 | A1* | 9/2014 | Parsche | H01Q 9/28 343/791 |

OTHER PUBLICATIONS

European Search Report mailed Sep. 15, 2014; 8 pages.

* cited by examiner

*Primary Examiner* — Trinh Dinh
(74) *Attorney, Agent, or Firm* — McGarry Bair PC

(57) ABSTRACT

A dipole antenna comprises a hollow dielectric whip, a coaxial center feed extending therethrough, and a pair of conductive dipole elements comprising an upper element and a lower element. The dipole antenna further comprises an upper element lead connecting the upper element to a first portion of the coaxial center feed at a feed point and a lower element lead connecting the lower element to a second portion of the coaxial center feed at the feed point. The dipole antenna further comprises a feed point strengthening means to mechanically strengthen the feed point against disconnection when the whip is impacted. Additionally, the dipole antenna may be a dual dipole antenna.

11 Claims, 6 Drawing Sheets

STRENGTHENING MEANS FOR A DIPOLE WHIP ANTENNA

CROSS-REFERENCE TO RELATED APPLICATIONS

This application is a National Phase application of International Application No. PCT/US2011/034767, filed May 2, 2011.

BACKGROUND OF THE INVENTION

1. Field of the Invention

The present invention relates generally to antennas, and more specifically to a strengthening means for a dipole whip antenna.

2. Description of the Related Art

The physical size of an antenna largely depends upon the purpose for which it is to be employed. For example, an antenna for receiving a particular frequency range must have an electrical length capable of resonating within that range to achieve optimum reception. Generally, lower frequencies require longer lengths because the wavelengths at lower frequencies are longer, but limitations in use often demand design modifications to achieve appropriate electrical length in a smaller space. It is known for antennas in some applications on mobile vehicles to be 10 feet or more in length.

Most such antennas are known as "whip" antennas because they have a thin, dielectric, flexible core that carries the electrical radiator and that is mounted to a vehicle by way of a spring. These types of antennas are known as "whip" antennas because the flexible core and spring together absorb energy from forces acting on the antenna, such as impacts. A typical core will be fiberglass. If a whip antenna were to impact an object while the vehicle is in motion, the flexible dielectric core and/or the spring can absorb the force of the impact, preventing damage to the antenna or its mounting.

Some antenna applications, however, are complex, requiring multiple frequency bands and electrical lengths that make the use of thin flexible whip antennas impractical. Such antennas may require hollow dielectric cores with diameters of 1 inch or more at a length of 10 feet, and consequently are more rigid. Impacts on such antennas tend to transfer forces to components within the hollow core such as feed lines and junctions, which may become dislodged and unable to function.

SUMMARY OF THE INVENTION

According to the invention, a dipole antenna comprises a hollow dielectric whip, a coaxial center feed extending through the hollow dielectric whip, and a pair of conductive dipole elements on the hollow dielectric whip comprising an upper element and a lower element. The dipole antenna further comprises an upper element lead connecting the upper element to a first portion of the coaxial center feed at a feed point and a lower element lead connecting the lower element to a second portion of the coaxial center feed at the feed point. The feed point is disposed on an axis in a cavity in the hollow dielectric whip. According to one embodiment of the invention, the dipole antenna further comprises a feed point strengthening means to mechanically strengthen the feed point against disconnection when the whip is impacted.

In one embodiment of the invention, the feed point strengthening means comprises at least two upper element leads and at least one lower element lead. In another embodiment of the invention, the feed point strengthening means comprises a circuit board secured to the first and second portions of the coaxial center feed and the upper and lower element leads are connected to the circuit board.

In yet another embodiment, the dipole antenna further comprises a second dipole antenna on the hollow dielectric whip. The second dipole antenna comprises a second pair of conductive dipole elements comprising a second upper element and a second lower element. A second upper element lead connects the second upper element to the first portion of the coaxial center feed at a second feed point, and a second lower element lead connects the second lower element to the second portion of the coaxial center feed at the second feed point. The second feed point is disposed on a second axis in a second cavity. According to one embodiment of the invention, the feed point strengthening means comprises orienting the axes of the two cavities perpendicular to one another.

In another embodiment of the invention, the dipole antenna strengthening means comprises four upper element leads and two lower element leads at any feed point.

DETAILED DESCRIPTION OF THE DRAWINGS

Figure 1:
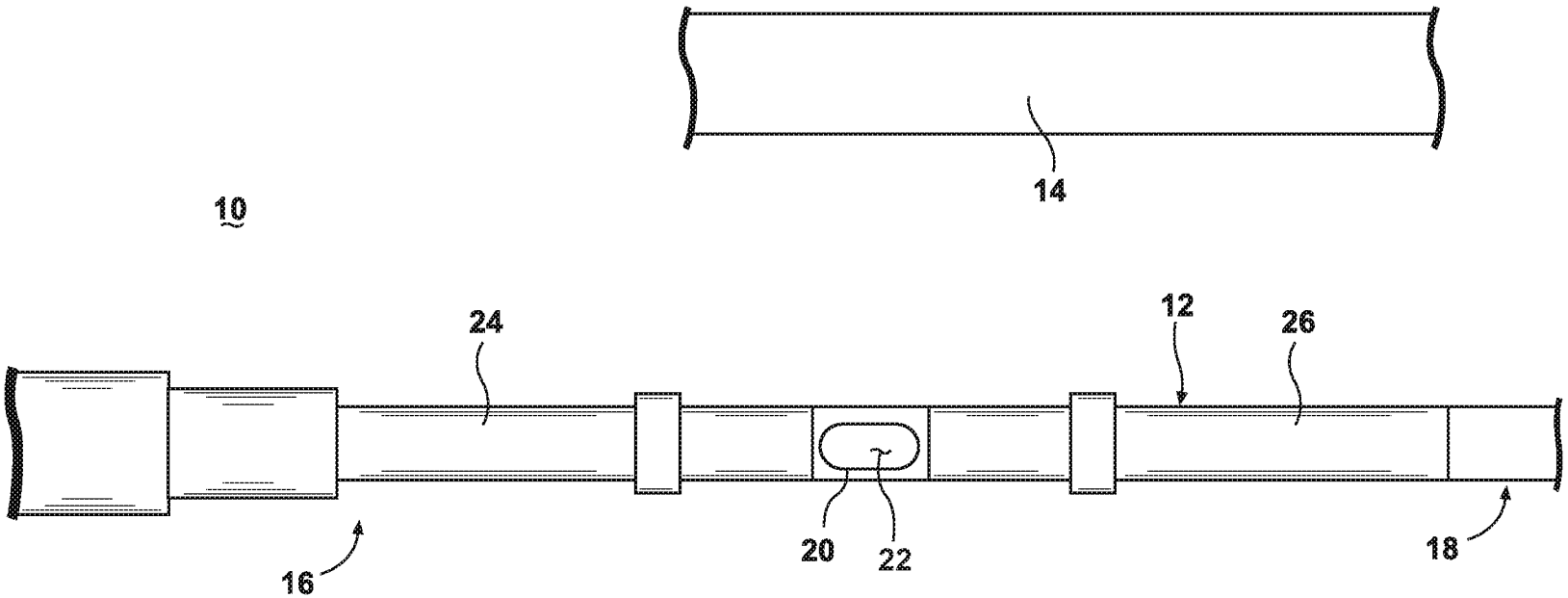
FIG. 1 is a perspective view of a first embodiment of a dipole antenna according to the invention.
Figure 2:
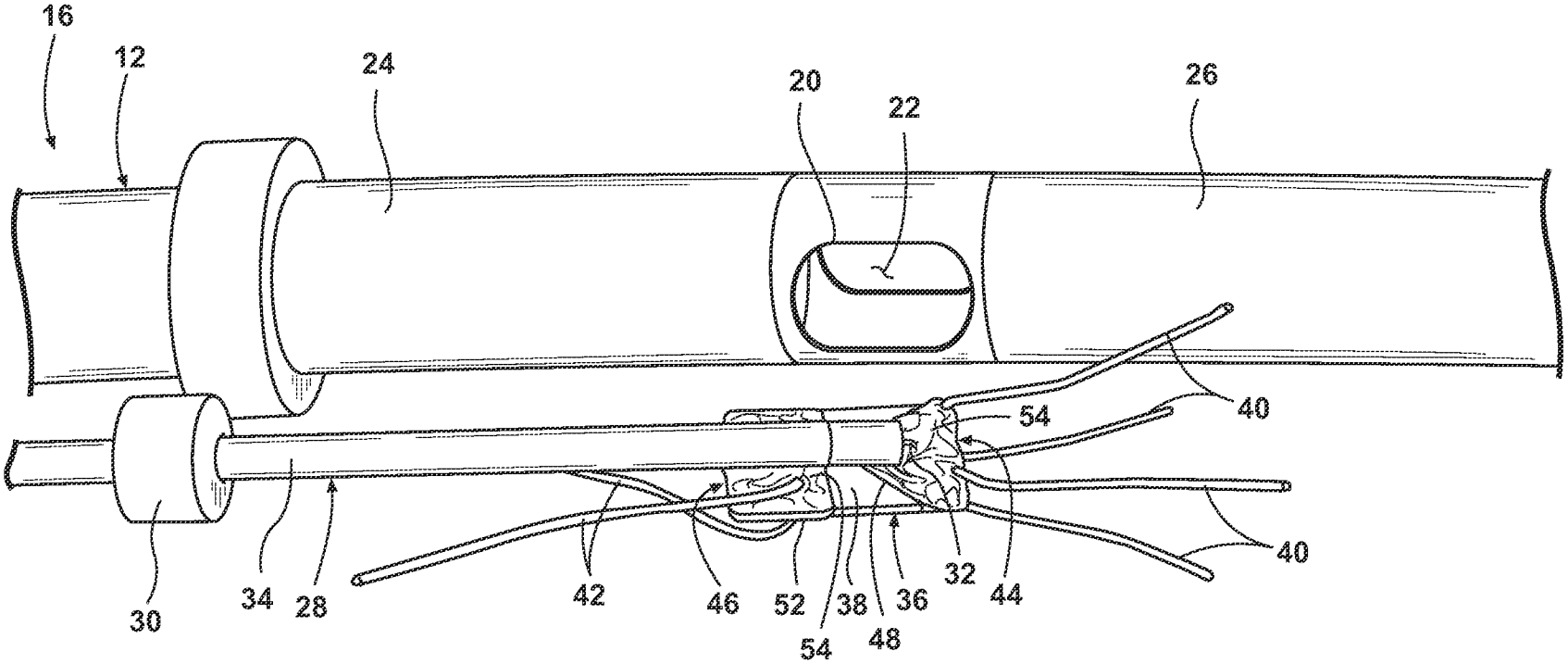
FIG. 2 is a perspective view of a dipole of the dipole antenna of FIG. 1.

Referring now to the drawings, FIGS. 1 and 2 illustrate a dipole antenna 10 according to one embodiment of the invention. The dipole antenna 10 can be included as a portion of a multiband antenna comprising a mount assembly and a whip assembly. The mount is conventional and can be affixed to a vehicle by any suitable means, typically by bolting the multiband antenna to the vehicle. The mount may contain any number of electrical connections and/or components for use with the multiband antenna and vehicle, or other structure to which it is affixed. The electrical structure of the multiband antenna is commonly known in the art, and is not germane to the invention. These portions of the multiband antenna will not be described in detail except as necessary for a complete understanding of the invention.

Dipole antenna 10 comprises a hollow dielectric whip, illustrated as a dielectric tube 12, enclosed in a non-conductive housing 14. The dielectric tube 12 has a lower end 16, an upper end 18, and at least one slot defining a feed point 20. Feed point 20 is spaced intermediate the lower and upper ends 16, 18 and is located within a cavity 22 formed in the hollow dielectric tube 12. Conductive dipole elements, lower element 24 and upper element 26, are spaced from each other on opposite sides of the feed point 20. The conductive elements 24, 26 can be metal foil, preferably wrapped around the dielectric tube 12.

A coaxial center feed cable 28, supported by at least one cable sleeve 30, extends out of the lower end 16 through the dielectric tube 12. The cable sleeves 30 are adapted to support one or more cables extending through the interior of the dielectric tube 12 to maintain them centered within the tube 12. The center feed cable 28 is of the type of a commonly known coaxial cable comprising a conductive core 32 and a conductive shield 34 spaced from the conductive core 32 by a dielectric insulator. Other suitable forms of transmission lines can be used, as is commonly known in the art.

The center feed cable 28 extends to a connector 36 that is positioned at the feed point 20, the connector 36 being positioned within the cavity 22. The connector 36 comprises a circuit board 38, at least two upper element leads 40, and at least one lower element lead 42. The circuit board 38 is of the commonly known type with various components and electrical traces disposed thereon. The circuit board 38 can be made of any known insulative material used for such applications.

The circuit board 38 comprises an upper half 44 and a lower half 46. The upper half 44 comprises an upper conductive element 48 disposed on the circuit board 38 and a plurality of through-holes (not shown) that extend through the thickness of the circuit board 38. The lower half 46 of the circuit board 38 is of similar construction, comprising a lower conductive element 52 disposed on the circuit board 38 and a plurality of through-holes. The through holes may be electrically conductive and may be formed concurrently by methods known in the field of circuit board manufacturing, such as by electroless plating or electroplating.

The conductive core 32 of the center feed cable 28 is connected to the upper conductive element 48 on the circuit board 38 by solder 54, or any other known method of attaching discrete components to circuit boards. The solder 54 can be of any known type including, but not limited to, standard lead-tin (Pb—Sn) alloy or tin-silver-copper (SAC) alloy to meet stringent environmental regulations of Europe and Japan. The solder 54 may be applied to the circuit board 38 by any known method including, but not limited to, screen printing solder paste or high volume wave soldering techniques.

The plurality of upper element leads 40 are also connected by solder 54 to the upper conductive element 48 on the circuit board 38. In one embodiment, the connector 36 comprises two upper element leads 40. In another embodiment, the connector 36 comprises four upper element leads 40. The upper element leads 40 may be connected to the upper conductive element 48 by individually soldering each lead 40 to the upper conductive element 48. In another option, the upper element leads 40 may be formed of a single lead that passes through the through hole (not shown), each half of the single lead defining one upper element lead 40. The single lead may be soldered to the upper conductive element 48 in a similar fashion. In any of these configurations, the plurality of upper element leads 40 are electrically connected to the conductive core 32 of the center feed cable 28 via upper conductive element 48.

On the lower half 46 of the circuit board 38, lower element lead 42 is connected by solder 54 to the lower conductive element 52. In one embodiment, the connector 36 comprises one lower element lead 42. In a second embodiment, the connector 36 comprises two lower element leads 42. The lower element leads 42 may be connected to the lower conductive element 52 by individually soldering each lead 42 to the lower conductive element 52. In another option, the lower element leads 42 may be formed of a single lead that passes through the through hole (not shown), each half of the single lead defining one lower element lead 42. The single lead may be soldered to the lower conductive element 52 in a similar fashion. In any of these configurations, the plurality of lower element leads 42 are electrically connected to the conductive shield 34 of the center feed cable 28, providing a ground connection for the dipole antenna 10.

The upper element leads 40 pass out of the dielectric tube cavity 22 and are attached to the upper element 26, thereby electrically connecting the upper element 26 to the conductive core 32 of the center feed cable 28. The lower element lead 42 pass out of the dielectric tube cavity 22 and are attached to the lower element 24, thereby electrically connecting the lower element 24 to the conductive shield 34 of the center feed cable 28.

Dependent on the number included, the upper element leads 40 may be oriented in several different configurations. For example, wherein the connector 36 has two upper element leads 40, they may be oriented substantially diametrically opposite one another other. In another example, wherein the connector 36 has four upper element leads 40, they may be oriented and spaced evenly about the upper element 26. Similarly, wherein the connector 36 has two lower element leads 42, they may be oriented substantially diametrically opposite one another other.

In a second embodiment of the invention, illustrated in FIGS. 3-6, the dipole antenna comprises the first dipole antenna 10 and a second dipole antenna 100, together defining a coaxial dual dipole antenna 90. The dual dipole antenna 90 comprises the first dipole antenna 10 and a dielectric tube 112 enclosed in a non-conductive housing 114. The dielectric tube 112 has a lower portion 102 in which the first dipole antenna 10 is enclosed, and an upper portion 104 in which the second dipole antenna 100 is enclosed. The upper portion 104 comprises a lower end 116, an upper end 118, and at least one slot defining a second feed point 120. Second feed point 120 is spaced intermediate the lower and upper ends 116, 118 and is located within a second cavity 122 formed in the hollow dielectric tube 112. Conductive dipole elements, second lower element 124 and second upper element 126, are spaced from each other on opposite sides of the second feed point 120. The conductive elements 124, 126 can be metal foil, preferably wrapped around the dielectric tube 112.

Figure 4:
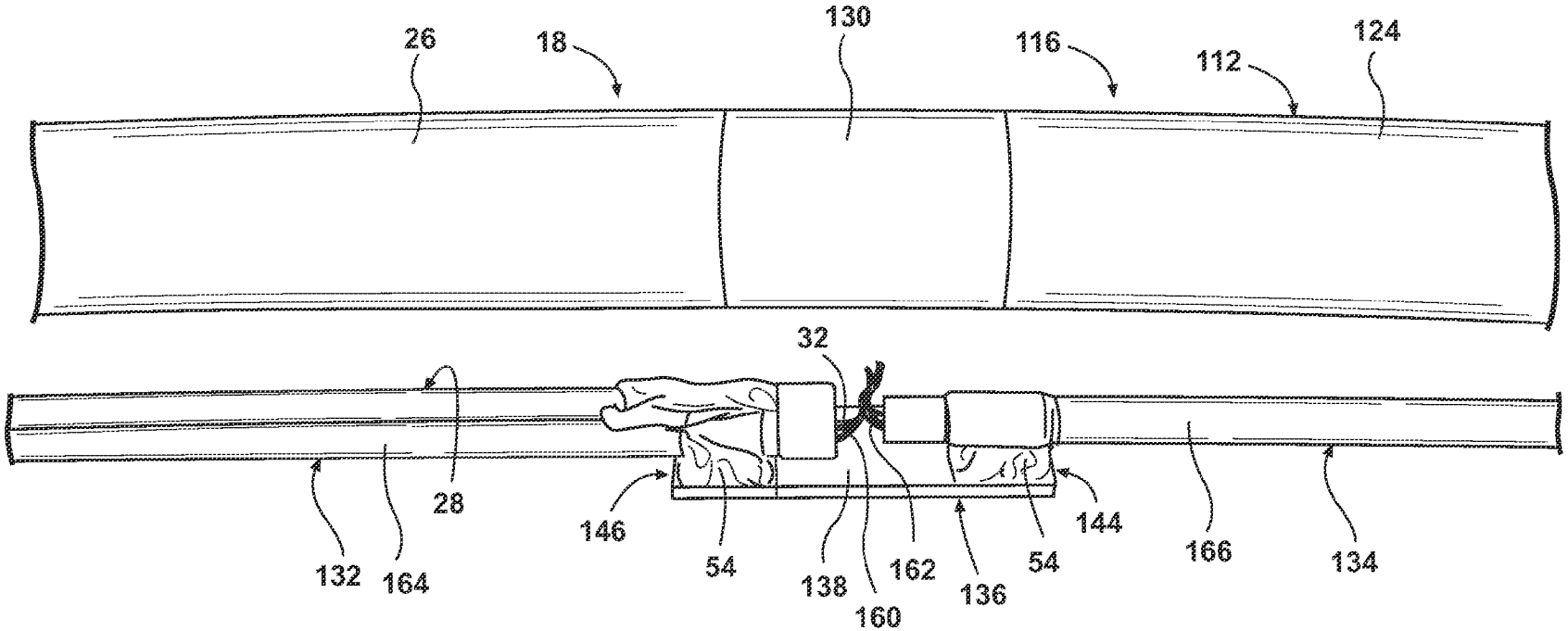
FIG. 4 is a perspective view of a center point and center connector of the dual dipole antenna of FIG. 3.

Referring to FIG. 4, the coaxial center feed cable 28, supported by at least one cable sleeve 30, extends out of the lower end 16 through the dielectric tube 112. In this second embodiment, the center feed cable 28 extends past the first connector 36 to a center connector 136 that is positioned at a center feed point 130 along the dielectric tube 112. The center connector 136 comprises a center circuit board 138 having an upper half 144 and a lower half 146. The center connector 136 forms a junction, both mechanical and electrical, to join the center feed cable 28 with a lower dipole lead 132 and an upper dipole lead 134. The center feed cable 28 and lower and upper dipole leads 132, 134 may be attached to the center circuit board 138 by any suitable mechanical means, such as soldering.

The lower and upper dipole leads 132, 134 are electrically connected to the center feed cable 28. Like the center feed cable 28, the lower and upper dipole leads 132, 134 each comprise a conductive core, lower conductive core 160 and upper conductive core 162, respectively, and a conductive shield, lower conductive shield 164 and upper conductive shield 166, respectively. The three conductive cores 32, 160, 162 are mechanically and electrically connected together and the three conductive shields 34, 164, 166 are mechanically and electrically connected together.

Figure 5:
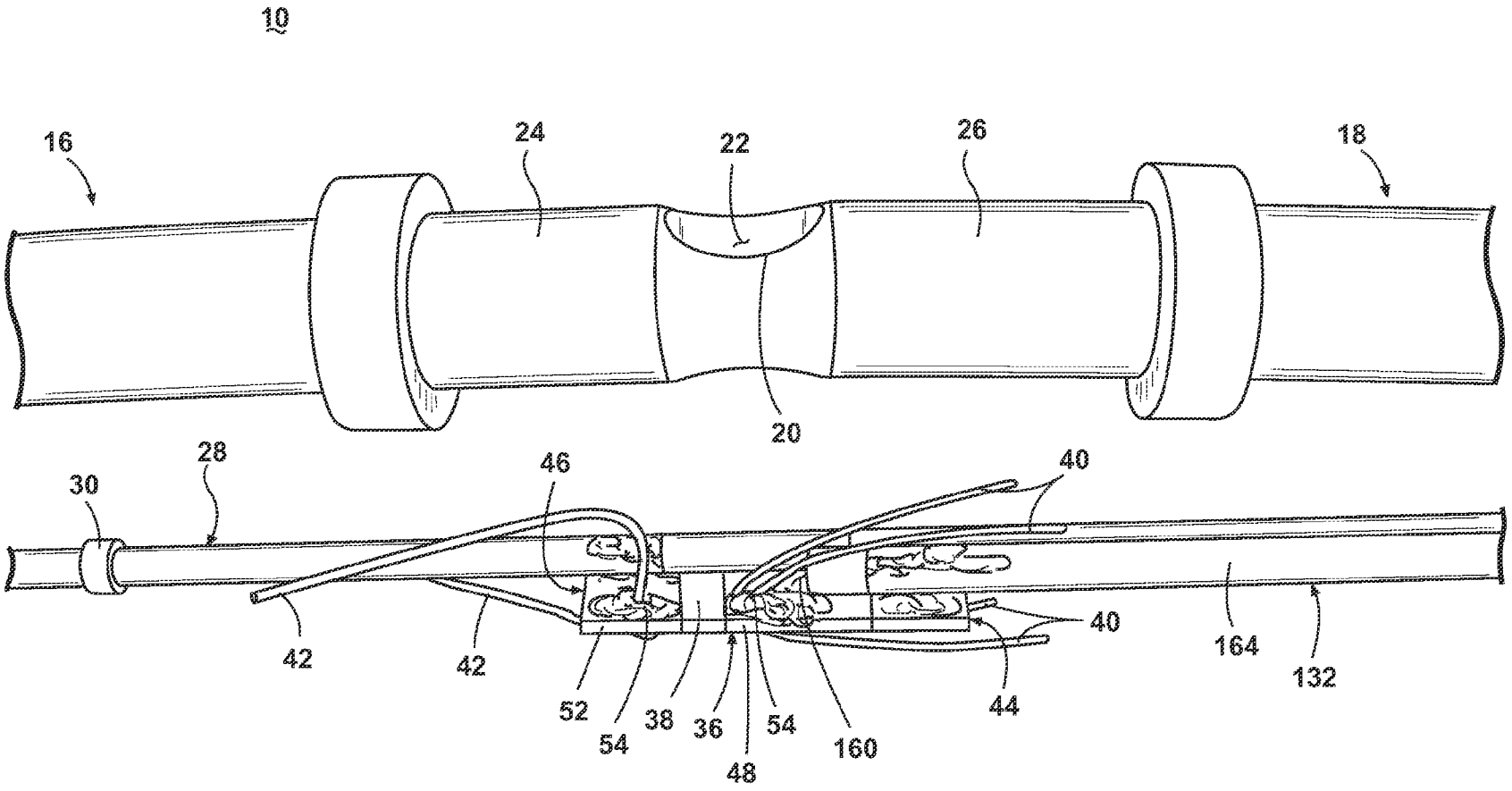
FIG. 5 is a perspective view of a lower dipole of the dual dipole antenna of FIG. 3.

Referring to FIG. 5, the lower dipole lead 132 extends downward from the center connector 136 to the first connector 36. In the dual dipole antenna 90, the first dipole antenna 10 is electrically connected to the center feed cable 28 via the lower dipole lead 132, not directly to the center feed cable 28, as described above for the first embodiment. The center feed cable 28 may be mechanically affixed to the circuit board 38 of the connector 36 however, to provide additional stability to the connection.

At the lower end of the lower dipole lead 132, the lower conductive core 160 is connected to the upper conductive element 48 on the circuit board 38 of the first connector 36 by solder 54. The remainder of the first connector 36 remains unchanged from that of the first embodiment.

Figure 6:
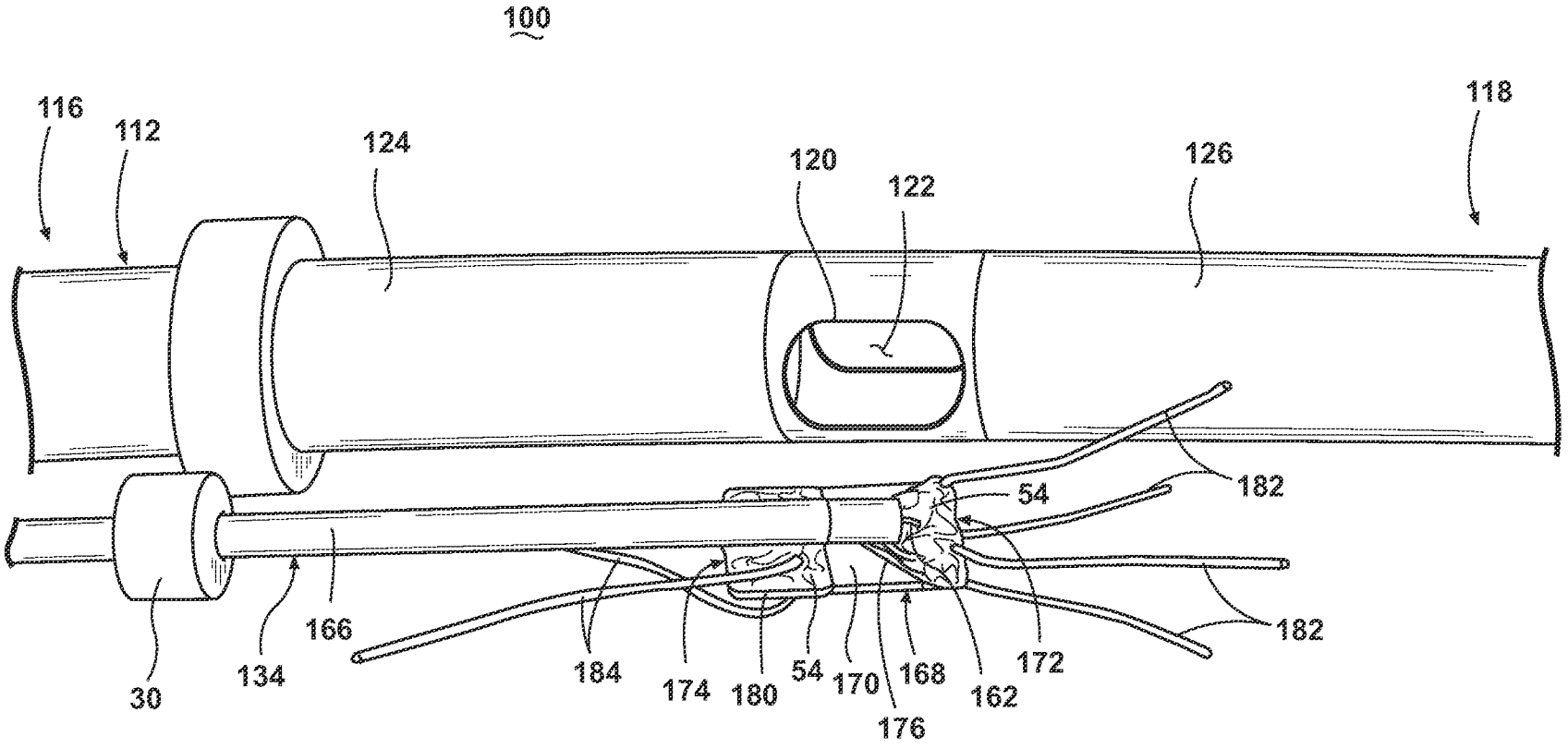
FIG. 6 is a perspective view of an upper dipole of the dual dipole antenna of FIG. 3.

Referring to FIG. 6, the upper dipole lead 134 extends upward from the center connector 136 to a second connector 168. The second connector 168 is much like the first connector 36. The second connector 168 comprises a second circuit board 170 having an upper half 172 and a lower half 174. The upper half 172 comprises an upper conductive element 176 disposed on the second circuit board 170 and a plurality of through-holes (not shown) that extend through the thickness of the second circuit board 170. The lower half 174 of the second circuit board 170 is of similar construction, comprising a lower conductive element 180 disposed on the second circuit board 170 and a plurality of through-holes (not shown). The through holes may be electrically conductive.

The upper conductive core 162 of the upper dipole lead 134 is connected to the upper conductive element 176 on the second circuit board 170 by solder 54, or any other known method of attaching discrete components to circuit boards. A plurality of upper element leads 182 are also connected by solder 54 to the upper conductive element 176 on the second circuit board 170. In one embodiment, the second connector 168 comprises two upper element leads 182. In another embodiment, the second connector 168 comprises four upper element leads 182. The upper element leads 182 may be connected to the upper conductive element 176 by individually soldering each lead 182 to the upper conductive element 176. In another option, the upper element leads 182 may be formed of a single lead that passes through the through hole (not shown), each half of the single lead defining one upper element lead 182. The single lead may be soldered to the upper conductive element 176 in a similar fashion. In any of these configurations, the plurality of upper element leads 182 are electrically connected to the conductive core 32 of the center feed cable 28 via upper conductive element 176 and upper dipole lead 134.

On the lower half 174 of the second circuit board 170, a lower element lead 184 is connected by solder 54 to the lower conductive element 180. In one embodiment, the connector 170 comprises one lower element lead 184. In another embodiment, the connector 170 comprises two lower element leads 184. The lower element leads 184 may be connected to the lower conductive element 180 by individually soldering each lead 184 to the lower conductive element 180. In another option, the lower element leads 184 may be formed of a single lead that passes through the through hole (not shown), each half of the single lead defining one lower element lead 184. The single lead may be soldered to the lower conductive element 180 in a similar fashion. In any of these configurations, the lower element lead(s) 184 are electrically connected to the conductive shield 34 of the center feed cable 28, via lower conductive element 180 and the upper conductive shield 166 of upper dipole lead 134, providing a ground connection for the second dipole antenna 100.

The upper element leads 182 pass out of the dielectric tube second cavity 122 and are attached to the second upper element 126, thereby indirectly electrically connecting the second upper element 126 to the conductive core 32 of the center feed cable 28. The lower element leads 184 pass out of the dielectric tube second cavity 122 and are attached to the second lower element 124, thereby electrically connecting the second lower element 124 to the conductive shield 34 of the center feed cable 28.

According to one embodiment of the invention, the ability of the antenna 10, 90 to impact an object without sustaining damage to the antenna 10, 90 is increased as a result of any one of the aforementioned strengthening means, taken alone or in combination. The feed point strengthening means mechanically strengthens the feed point 20, 120 against disconnection when the whip is impacted. Referring to FIGS. 2, 5, and 6, a first strengthening means comprises at least two upper element leads 40, 182 and at least two lower element leads 42, 184 at the feed point 20, 120, as described above. More preferably, the strengthening means comprises four upper element leads 40, 182 and two lower element leads 42, 184 at the feed point 20, 120. The redundant mechanical and electrical connections through the utilization of repetitive upper and lower element leads 40, 182 and 42, 184 provide a factor of safety in the possibility that any of the leads 40, 182, 42, 184 may break or become disconnected when the antenna 10, 90 is impacted. For example, if one pair of upper element leads 40 were to become disconnected, the second pair would maintain electrical connection between the center feed cable 28 and the upper element 26 and the antenna 10, 90 would remain functional.

Referring to FIGS. 2, and 4-6, a second means of strengthening the antenna 10, 90 comprises the inclusion of the circuit board 38, 170 to mechanically and electrically connect the coaxial center feed cable 28 and the upper and lower elements 26, 126 and 24, 124, as described above. The circuit board 38 provides added rigidity at the feed points 20, 120. This increases the connectors' 36, 168 ability to take an impact without sustaining damage. In a similar manner, the center circuit board 138 further strengthens the center connector 136.

Figure 3:
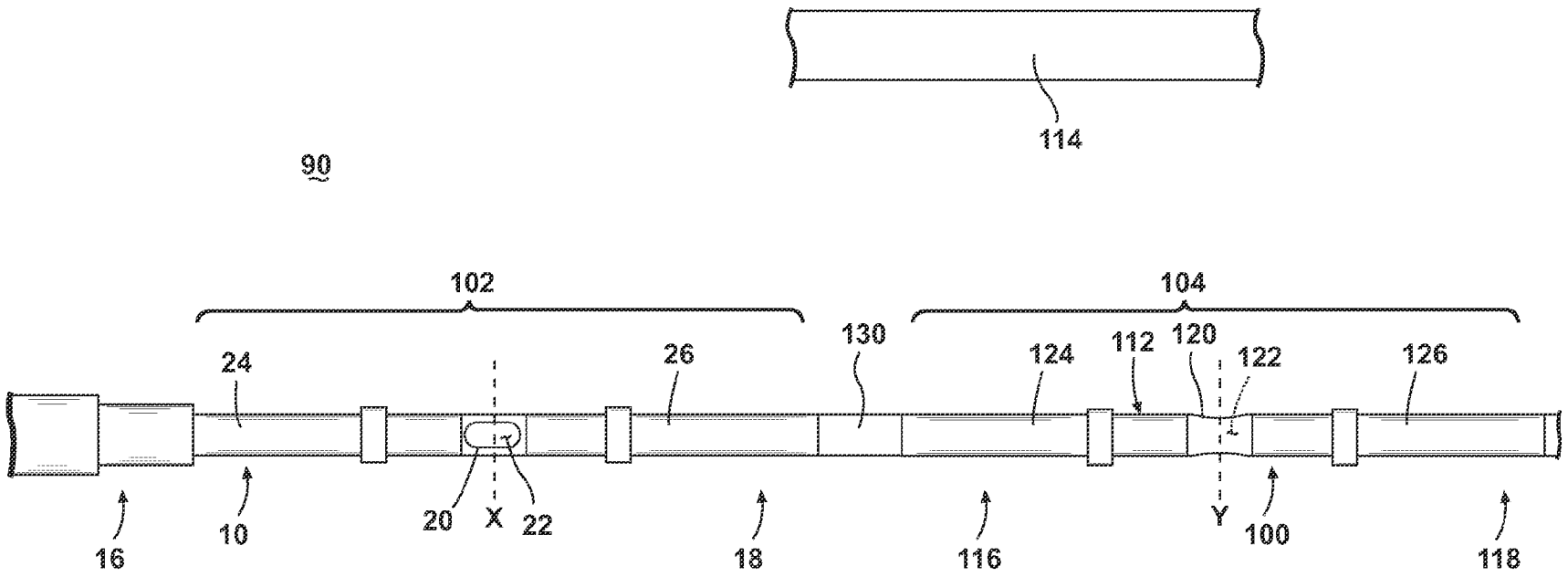
FIG. 3 is a perspective view of a dual dipole antenna according to a second embodiment of the invention.

A third means of strengthening the antenna 90 comprises orienting the axes of the two feed point cavities 22, 122 perpendicular to one another. Referring to FIG. 3, it can be seen that each cavity 22, 122 lies along the central axis, parallel to the length of the antenna 10, 90. Each cavity 22, 122 is further defined by a second axis which is perpendicular to the first axis, and which extends along the opening of the cavity 22, 122. The second axis of cavity 22 is referred to in the figures as X, and the second axis of cavity 122 is referred to as Y. To increase the rigidity of the antenna 90, the axes X and Y are oriented perpendicular to one another. This relative orientation increases the antenna's resistance to bending and deflection in a given direction.

As previously stated, these strengthening means can be included on the antenna 10, 90 either individually, or in various combinations with one another. It should be obvious that the third strengthening means cannot be implemented on the antenna 10 because antenna 10 only comprises one cavity 22, however.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dipole antenna comprising:

a hollow dielectric whip, a coaxial center feed extending through the hollow dielectric whip, a first pair of conductive dipole elements on the hollow dielectric whip comprising a first upper element and a first lower element, a first upper element lead connecting the first upper element to a first portion of the coaxial center feed at the at least one first feed point, a first lower element lead connecting the first lower element to a second portion of the coaxial center feed at the at least one first feed point, wherein the at least one first feed point is disposed on a first axis of a first cavity in the hollow dielectric whip, a second pair of conductive dipole elements comprising a second upper element and a second lower element, a second upper element lead connecting the second upper element to the first portion of the coaxial center feed at a second feed point, and a second lower element lead connecting the second lower element to the second portion of the coaxial center feed at the second feed point, wherein the second feed point is disposed on a second axis of a second cavity, wherein the first cavity and second cavity each has a central axis parallel to the length of the hollow dielectric whip, and the first and second axes are oriented perpendicular to one another.

2. A dipole antenna according to claim 1 comprising at least two upper element leads and at least one lower element lead.

3. A dipole antenna according to claim 2 wherein the strengthening means comprises four upper element leads and two lower element leads at any feed point.

4. A dipole antenna according to claim 2 wherein any two upper element leads are oriented substantially diametrically opposite each other, and any two lower element leads are oriented substantially diametrically opposite each other.

5. A dipole antenna according to claim 1 comprising a circuit board secured to the first and second portions of the coaxial center feed and the first upper and first lower element leads connected to the circuit board.

6. A dipole antenna according to claim 1 wherein the first and second pairs of conductive dipole elements are coaxial.

7. A dipole antenna according to claim 1 wherein the first and second pairs of conductive dipole elements are connected to the first portion of the coaxial center feed at a center feed point.

8. A dipole antenna according to claim 1 comprising four element leads and two lower element leads at any feed point.

9. A dipole antenna according to claim 8 wherein the four upper element leads are oriented and spaced evenly about any of the first and second upper elements.

10. A dipole antenna according to claim 1 wherein the two upper element leads are oriented substantially diametrically opposite each other, and the two lower element leads are oriented substantially diametrically opposite each other.

11. A dipole antenna according to claim 1 wherein the first portion is a conductive core and the second portion is a conductive shield spaced from the conductive core by a dielectric insulator.

* * * * *